United States Patent [19]

Romier et al.

[11] Patent Number: 4,511,776

[45] Date of Patent: Apr. 16, 1985

[54] BREAK CHAMBER FOR A GAS-BLAST CIRCUIT BREAKER

[75] Inventors: Roger Romier, Sainte Foy les Lyon; Jean-Pierre Bétolière, Villeurbanne, both of France

[73] Assignee: Alsthom-Atlantique, Paris, France

[21] Appl. No.: 545,580

[22] Filed: Oct. 26, 1983

[30] Foreign Application Priority Data

Oct. 28, 1982 [FR] France ..... 82 18099

[51] Int. Cl.[3] ..... H01H 33/70

[52] U.S. Cl. ..... 200/148 A; 200/150 G

[58] Field of Search ..... 200/148 A, 150 G

[56] References Cited

U.S. PATENT DOCUMENTS 4,264,794 4/1981 Kii ..... 200/148 A 4,381,436 4/1983 Nagaoka et al. ..... 200/148 A

*Primary Examiner*—Robert S. Macon

*Attorney, Agent, or Firm*—Sughrue, Mion, Zinn, Macpeak and Seas

[57] ABSTRACT

A break chamber for a gas-blast circuit breaker comprising an insulating cylindrical housing (1) containing a fixed arcing contact (5), a fixed main contact (4), and a moving contact (6) passing through one end (3) of the housing. The housing is divided into a first portion (11) and a second portion (12) by a transverse partition. The first portion houses the fixed contacts. The second portion is itself subdivided into two adjacent zones of different diameters. The smaller diameter zone (12A) constitutes a cylinder for a piston (14) in the form of an annular disk fixed to the moving contact. The length of the smaller diameter zone is substantially equal to the length over which said fixed arcing contact (5) penetrates into said moving contact (6) when the circuit breaker is in its closed position.

6 Claims, 5 Drawing Figures

BREAK CHAMBER FOR A GAS-BLAST CIRCUIT BREAKER

The present invention relates to a break chamber for a gas-blast circuit breaker using a gas under pressure which has high circuit breaking qualities and which does not require a large quantity of energy for a circuit-breaking operation. Circuit breakers are known which have such qualities: they are circuit breakers using sulphur hexafluoride gas and in which gas puffer pressure is thermally generated.

BACKGROUND OF THE INVENTION

The energy required for breaking high intensity currents is provided by the arc which causes a large temperature rise in the gas and thus a large increase in its pressure. Energy stored in this manner is used to facilitate blasting the arc.

When the current to be interrupted is of small intensity, the energy developed by the arc is likewise small, and there comes a point where insufficient energy is released to break the circuit. It is therefore necessary to include auxiliary mechanical gas compressing means to act in the final stages of circuit breaking.

Preferred embodiments of the present invention provide break chambers capable of breaking currents at any intensity up to a maximum, while expending little energy.

SUMMARY OF THE INVENTION

The present invention provides a break chamber for a gas-blast circuit breaker, said chamber comprising an insulating cylindrical housing containing the following contacts disposed coaxially: a fixed arcing contact; a fixed main contact; and a moving contact passing through one end of the housing; said moving contact being tubular and, in the closed position of said circuit breaker, being penetrated over a given penetration length by said fixed arcing contact, the diameters of said fixed arcing contact and said moving contact being chosen to exclude metallic contact therebetween in said closed position; said housing being divided into first and second portions by a transverse partition having a central orifice for passage of the moving contact, said first portion containing said fixed contacts, the improvement wherein said second portion comprises two adjacent zones of differing cross sections, the zone of smaller cross section being disposed next to said passage and constituting a cylinder for a piston in the form of an annular disk fixed to the moving contact and having an outside diameter close to said smaller cross section, the stroke of said piston running from said passage to the end of said second portion, the length of the zone of smaller cross section being substantially equal to said given penetration length over which said fixed arcing contact penetrates into said moving contact when the circuit breaker is in said closed position.

BRIEF DESCRIPTION OF THE DRAWINGS

Embodiments of the invention are described by way of example with reference to the accompanying drawings, in which.

MORE DETAILED DESCRIPTION

Figure 1:
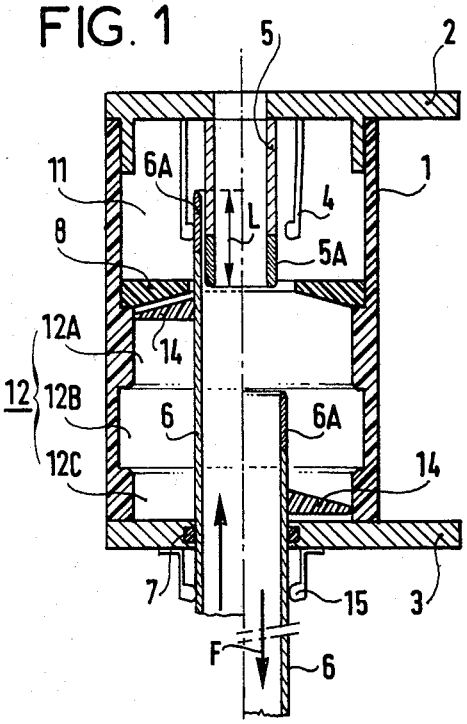
FIG. 1 is a diagrammatic axial section through a break chamber in accordance with a first embodiment of the invention.

FIG. 1 is a diagrammatic axial section through a first break chamber embodying the invention. The left hand side of the figure shows the circuit breaker in the closed position, while the right hand side shows the circuit breaker in the open position. The chamber shown in FIG. 1 is itself lodged in an enclosure (not shown) which is filled with an insulating gas such a sulphur hexafluoride $SF_6$ at slightly more than atmospheric pressure.

An insulating cylindrical housing 1 is closed at each end by respective end plates 2 and 3 which also serve as current-carrying connections.

The end plate 2 has a set of fixed contacts mounted thereon comprising a main fixed contact in the form of a ring of fingers 4 and an anti-spark arcing fixed contacts constituted by a metal tube having its tip 5A made of a refractory conductor material such as tungsten for improved resistance to wear under attack from the electric arc.

The chamber includes a moving tubular contact 6 which passes through the end plate 3 and which is connected to displacement means of known type (not shown) and located outside the break chamber. The tip 6A of the moving contact is likewise made of refractory material. The fixed arcing contact 5 penetrates a distance L into the moving contact 6 when the circuit breaker is in the closed position. Metallic connection between these coaxial contacts when in the closed position is provided solely via the fingers 4.

A sealing ring 7 provides a degree of sealing between the inside and the outside of the cylindrical housing at the point where the moving contact passes through the end plate 3.

Electrical contact between the moving contact 6 and the end plate 3 is provided by sliding contacts 15.

The inside or chamber of the housing is split in two by an insulating partition 8 which is substantially level with the tip of the antispark contact 5 and which serves as a blast nozzle. The housing thus has a first chamber portion 11 in which the fixed contacts are located and a chamber portion 12 in which the moving contact is located.

The center of the partition has a circular orifice to allow the moving contact 6 to pass into the portion 11 to engage the fixed contacts. The fixed arcing contact extends up to the partition so that when the circuit breaker is in the closed position, the first portion 11 is substantially sealed by the contacts and the partition 8.

The second portion 12 has a first zone 12A situated adjacent to the partition, and then a second zone 12B adjacent to the first zone 12A. The first zone 12A is of smaller diameter than the second zone 12B.

A third zone 12C extends for a short distance between the other side of the second zone 12B and the end plate 3. The third zone 12C is of substantially the same diameter as the first zone 12A.

The first zone 12A is about the same length as the penetration distance L defined above by which the contact 5 penetrates into the contact 6 when the circuit breaker is in the closed position.

A piston 14 of slightly smaller outside diameter than the first zone 12A is fixed to the moving rod or contact 6.

The circuit breaker operates as follows:

When in the closed position (left hand side of FIG. 1), electric current passes from the end plate 2 into the fingers 4, and thence into the moving contact 6, the sliding fingers 15 and finally to the other end plate 3.

Opening when there is no current passing

On opening, the moving contact 6 is moved in the direction of arrow F, FIG. 1, and the volume of the portion 11 of the housing remains substantially constant except for the volume of the tip of the tubular rod 6.

The volume between the piston 14 and the partition 8 which is nearly zero when the circuit breaker is in the closed position now increases, sucking in gas from the portion 11.

The volume on the other side of the piston decreases, with the piston compressing the gas until it reaches the second zone 12B. At this point free communication is established between the zones on either side of the piston 14.

It is thus necessary to supply not only the energy required to set the moving members in motion, but also the energy required to compress the volume of gas situated in the portion 12 of the chamber and to suck gas from the portion 11. This additional energy requirement is not large.

At the end of its stroke, the piston acts as a damper by compressing gas in the third zone 12C.

Interrupting a heavy current

The circuit breaker is opened as described above, but when the fingers 4 lose contact with the tip 6A of the moving contact 6, an arc is struck therebetween, and the arc heats the gas in the portion 11 of the chamber by an amount depending on the amplitude of the arc. The pressure in the portion 11 of the chamber therefore rises after an initial slight fall and gas escapes into the volume lying between the piston 14 and the partition 8, thereby helping to compress the gas on the other side of the piston. The gas has difficulty penetrating into the tubular contact 6 which is still plugged for the time being by the arcing contact 5.

The arc switches from the fingers 4 to the arcing contact 5 and becomes established between the tips 5A and 6A both of which are made of refractory material to withstand the arc.

As the end of the contact 6 moves level with the end of the contact 5, free communication is established between the volumes on either side of the partition and the inside volume of the contact 6 and also the inside of the arcing contact 5 if a tubular arcing contact is provided (as shown in FIG. 1). The hot gas compressed inside the chamber expands through the gap and extinguishes the arc on the next zero passage of the current.

Interrupting light currents

The energy evolved when the arc is struck between the fingers 4 and the moving contact tip 6A is just sufficient to counter the drop in pressure in the portion 11 of the chamber by displacement of the piston 14.

The arc extends between the contacts 6 and 4 and then between the contacts 6A and 5A. When the piston arrives in the second zone 12B, the gas which has been compressed therein expands into the first zone 12A and then into the contacts 6 and 5, thereby blasting the arc which is extinguished on the next zero passage of the current. The arc in such cases is generally a thin arc. In this case the energy required for breaking the circuit is the same as the energy required for opening the circuit breaker when no current is flowing.

Closing the circuit breaker

When the circuit breaker is closed under load, the moving contact 6 moves in the opposite direction to the arrow F, and an arc is struck between the arcing contact 5 and the moving contact 6 before contact is made with the fingers 4. The arc is very short since it extends from the inside diameter of the contact 6 to the outside diameter of the contact 5, and it is it rapidly shunted by the contact 6 coming into contact with the fingers 4.

It will be seen that the tube 5 serves both as an arcing contact, particularly on closure, and also as a deflector for improving blasting since it partially closes the volume 11.

By combining two forms of blasting in this manner, ie. thermal blast generation and mechanical blast generation, a circuit breaker is obtained whose energy requirement for interrupting a current remains low regardless of the value of the current to be interrupted.

FIG. 1 shows a circuit breaker having high interrupting power.

The tubular arcing contact 5 contributes to the evacuation of the hot gasses which also pass through the moving contact 6.

Figure 2:
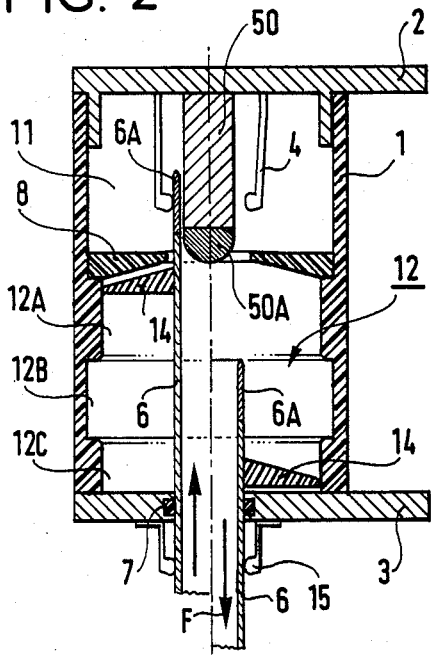

When the invention is applied to lower power interrupters, the fixed arcing contact may be a solid rod as shown at 50 in FIG. 2 where the other details and reference numerals are unchanged. Reference 50A designates a hemispherical contact tip on the rod 50.

The gasses then escape during interruption via the bore of the moving contact 6.

Figure 3:
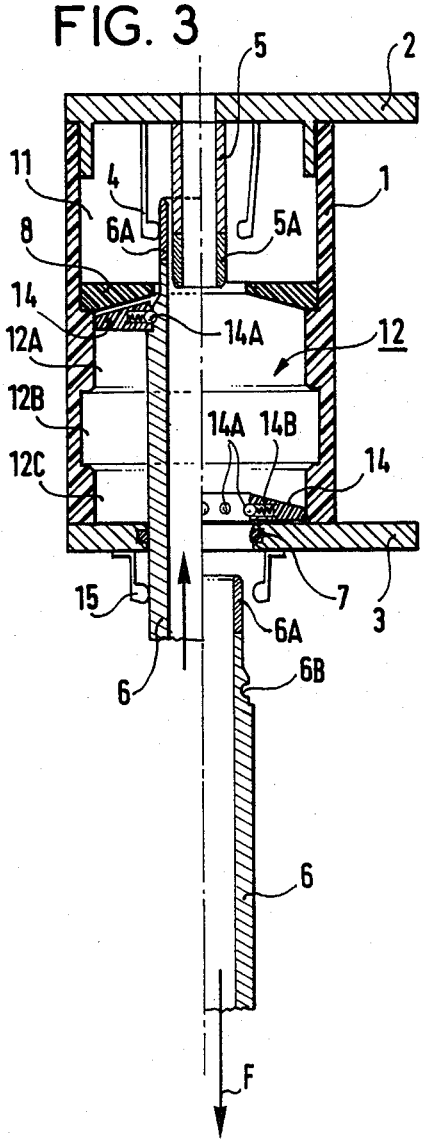
FIGS. 2, 3, and 4 are diagrammatic axial sections through variants of the invention.

The variant shown in FIG. 3 corresponds to an application of the invention to high tension circuit breakers (ie. operating at more than 30 kV).

To prevent leakage lines and stresses on the housing 1, the piston 14 disconnects from the tube 6 at the end of the stroke, as can be seen in FIG. 3 which uses the same reference numerals as FIG. 1.

In order to connect and to disconnect the piston 14 and the tube 6, the piston has ball bearings 14A urged radially inwardly by respective springs 14B. The tube 6 has a groove 6B for cooperative engagement with the ball bearings.

Figure 4:
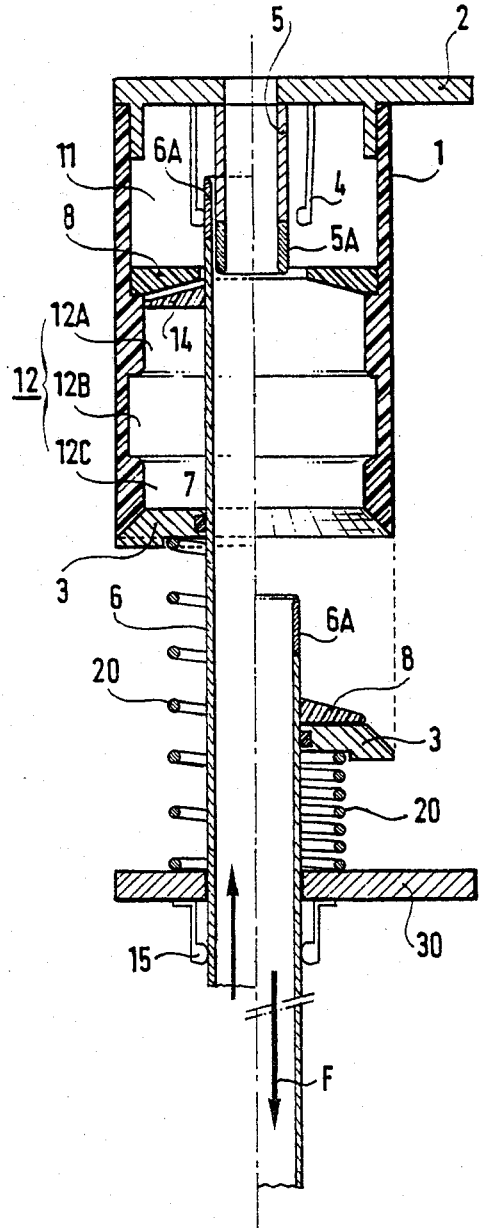

FIG. 4 shows a variant in which the end plate 3 is held in place by a spring 20 which bears against a fixed plate 30. At the end of a stroke, the piston pushes away the end plate 3, thereby adding a mechanical discontinuity between the current carrying connections 2 and 3.

Figure 5:
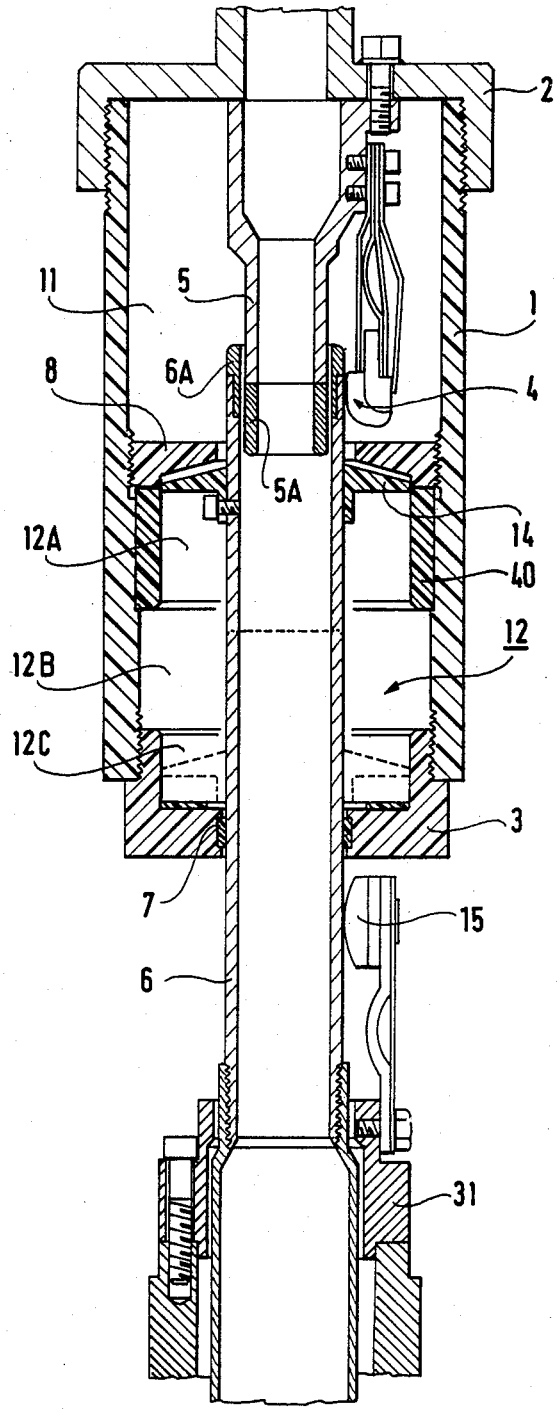
FIG. 5 is an axial section through a practical implementation of the FIG. 1 break chamber.

FIG. 5 shows a practical embodiment of the FIG. 1 circuit breaker.

The fingers 4 are covered with a covering that stands up well to arcing. The first zone 12A is covered with an insulating sleeve 30.

The ring of fingers 15 is fixed to a conductive block 31 which is made itself fixed to the end of the enclosure.

Further, in a variant (not shown) the contacts 5A and 50 may be isolated from the connection 2, eg. by a member of insulating material, whereby sufficient arcing voltage is maintained to provide energy for heating the gas in the volume 11.

We claim:

1. A break chamber for a gas-blast circuit breaker, the chamber comprising an insulating cylindrical housing containing the following contacts disposed coaxially: a fixed arcing contact; a fixed main contact; and a moving contact passing axially through one end of the housing;

said moving contact being tubular and, in the closed position of said circuit breaker, being penetrated over a given penetration length by said fixed arcing contact, the diameters of said fixed arcing contact and said moving contact being chosen to exclude metallic contact therebetween in said closed position; said housing being divided into first and second chamber portions by a transverse partition having a central orifice for passage of the moving contact, said first chamber portion containing said fixed contacts, the improvement wherein said second chamber portion comprises two adjacent zones of differing cross sections including a zone of smaller cross section disposed next to said orifice and constituting a cylinder, a piston in the form of an annular disk fixed to the moving contact and having an outside diameter close to that of said zone of smaller cross section, the stroke of said piston running from said orifice to the end of said second portion, and the axial length of the zone of smaller cross section being substantially equal to said given penetration length over which said fixed arcing contact penetrates into said moving contact when the circuit breaker is in said closed position.

2. A break chamber according to claim 1, wherein said fixed arcing contact is tubular.

3. A break chamber according to claim 1, wherein said fixed arcing contact is a solid rod.

4. A break chamber according to claim 1, wherein said fixed main contact is connected to a current-carrying connection and wherein said fixed arcing contact is insulated from said connection.

5. A break chamber according to claim 1, further including means for disconnecting said piston from said moving contact at the end of a contact-breaking stroke, and for reconnecting it at the beginning of a contact-making stroke.

6. A break chamber according to claim 1, wherein said end of said cylindrical housing through which said moving contact passes, is itself movable by said piston at the end of a contact-breaking stroke.

* * * * *